US011072404B1

(12) United States Patent
Woodward

(10) Patent No.: US 11,072,404 B1
(45) Date of Patent: Jul. 27, 2021

(54) FLOATING DOCK CONSTRUCTION

(71) Applicant: Anthony M. Woodward, Portage La Prairie (CA)

(72) Inventor: Anthony M. Woodward, Portage La Prairie (CA)

( * ) Notice: Subject to any disclaimer, the term of this patent is extended or adjusted under 35 U.S.C. 154(b) by 0 days.

(21) Appl. No.: 16/663,538

(22) Filed: Oct. 25, 2019

(51) Int. Cl.
*B63C 1/02* (2006.01)
*B63B 3/06* (2006.01)
*B63B 35/34* (2006.01)

(52) U.S. Cl.
CPC ..... *B63C 1/02* (2013.01); *B63B 3/06* (2013.01); *B63B 35/34* (2013.01)

(58) Field of Classification Search
CPC .. B63C 1/00; B63C 1/02; B63B 27/00; B63B 27/14; B63B 34/00; B63B 35/00; B63B 35/34; B63B 35/38; B63B 35/44; B63B 3/00; B63B 3/06
USPC ..... 114/263, 266, 267; 405/219
See application file for complete search history.

(56) References Cited

U.S. PATENT DOCUMENTS

| | | | | |
|---|---|---|---|---|
| 3,323,479 | A | 6/1967 | Filak | |
| 3,861,340 | A | 1/1975 | Clingenpeel | |
| 5,192,161 | A * | 3/1993 | Helgesson | B63B 35/34 114/267 |
| 5,235,929 | A * | 8/1993 | Chester | B63C 1/02 114/266 |
| 5,911,542 | A | 6/1999 | Obrock et al. | |
| 6,089,176 | A | 7/2000 | Costello | |
| 8,402,908 | B2 * | 3/2013 | Gerst | B63B 35/38 114/263 |
| 8,701,582 | B2 | 4/2014 | Schmidt et al. | |
| 9,387,913 | B1 | 7/2016 | Dye | |
| 9,580,156 | B2 | 2/2017 | Wittenberg et al. | |
| 10,017,230 | B1 | 7/2018 | Diserio | |

* cited by examiner

*Primary Examiner* — Lars A Olson
(74) *Attorney, Agent, or Firm* — Cramer Patent & Design, PLLC; Aaron R. Cramer

(57) ABSTRACT

A floating dock is constructed from a plurality of dock units with each unit having an interior at least partially filled of empty and recycled beverage plastic bottles. Each unit also includes a non-skid upper surface and means to interconnect adjacent units together.

13 Claims, 5 Drawing Sheets

FLOATING DOCK CONSTRUCTION

RELATED APPLICATIONS

None.

FIELD OF THE INVENTION

The present invention relates to a floating dock construction device.

BACKGROUND OF THE INVENTION

It is a common sight to see a floating dock along bodies of water such as river, pond, or lake. They are easy to make, self-adjust for varying water levels, and can be easily removed or relocated as one deems necessary. However, they do require a means of buoyancy which is typically served by a steel barrel or drum, which poses several problems. First, the steel drum is subject to corrosion and subsequent leakage. Second, the failure of even just one drum on a smaller dock can mean the entire dock may sink. Third, such drums are difficult to obtain. Finally, society is dealing with records amount of waste and continually looking for meaningful ways to not only recycle but reuse common waste objects. Accordingly, there exists a need for a means by which floating docks can be redesigned in a manner which addresses the problems and concerns as described above. The development of the floating dock construction fulfills this need.

SUMMARY OF THE INVENTION

The inventor has recognized the aforementioned, inherent problems and lack in the art and observed that there is a need for a modular floating dock, comprising a box base having a pair of first sidewalls, a pair of second sidewalls, an interior, and a mesh base. The pair of first sidewalls are shorter than the pair of second sidewalls, the mesh base is wrapped around an exterior of the box base for fastening purposes while the mesh base extends onto the exterior side of the first sidewalls to help secure said mesh base in place. There is also a top walking surface configured as a rectangular prism. The top walking surface may be attached to the tops of the second pair of sidewalls. There is also a plurality of first fasteners joining the adjacent sidewalls at each of their distal ends, a plurality of second fasteners fastening the mesh base around the perimeter of the pair of first sidewalls and a plurality of third fasteners attaching the top walking surface to the tops of the second pair of sidewalls.

The mesh base may provide a plurality of openings into the interior of the box base to allow for water to freely move in and out of the box base. The sidewalls may be made of material selected from the group consisting of dimensional wood lumber, plastic, or recycled plastic. The mesh base may be made of material selected from the group consisting of anti-corrosive metal, aluminum, or stainless steel to withstand exposure in a water-based environment. The box base is three feet wide, ten feet long, and one foot high. The top walking surface may be made of dimensional wood lumber. The top walking surface may be made of synthetic wood. The first fasteners may be a plurality of nails or nail screws. The first fasteners may join the adjacent sidewalls at a ninety-degree angle. The second fasteners may be a plurality of staples. The first fasteners and the second fasteners may be made of an anti-corrosive material to stand up to exposure in a water-based environment.

The first fasteners and the second fasteners may be made of stainless steel to stand up to exposure in the water-based environment. The third fasteners may be a plurality of screws, to allow for easy removal of the top walking surface to access to the box base interior for cleaning, maintenance, or repair. There may also be a plurality of containers each with corresponding caps are contained in an array within the modular floating dock.

The containers may be a plurality of empty two liter bottles which are rinsed clean and tightly sealed via the corresponding caps. The containers and sealed corresponding caps may be arranged in a rectangular array such that they fill the box base interior while disposed in an upright manner. The device may also comprise a walkway having a pair of modular floating docks and a dock area made of a plurality of additional modular floating docks. The walkway may be made by fastening the modular floating docks together. The modular floating dock may support up to one thousand two hundred pounds.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
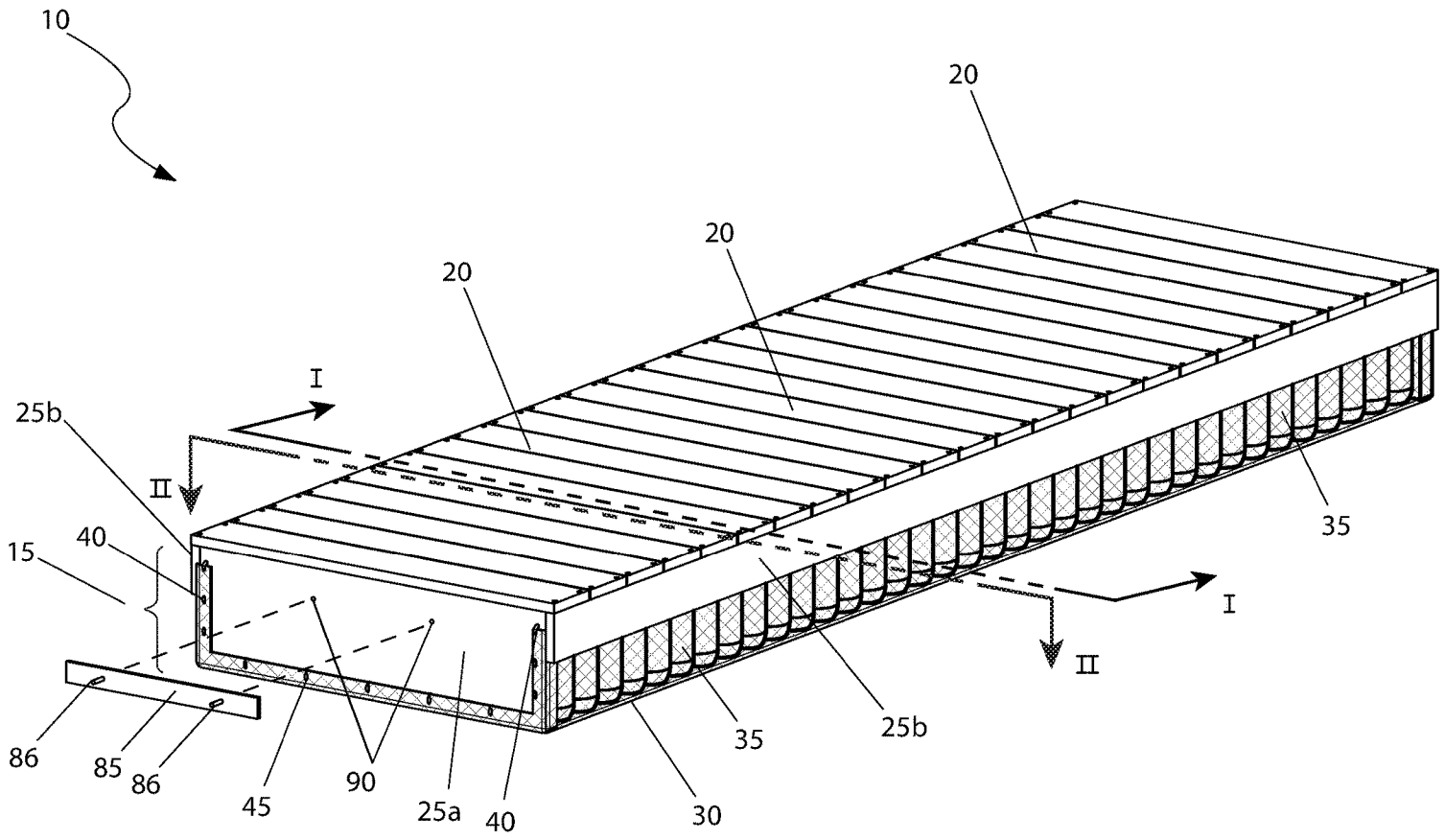
FIG. 1 is an isometric view of the modular floating dock 10, according to the preferred embodiment of the present invention.

10 modular floating dock
15 box base
20 top walking surface
25*a* first sidewall
25*b* second sidewall
30 mesh base
35 opening
40 first fastener
45 second fastener
50 third fastener
55 box base interior
60 container
65 cap
70 walkway
75 dock area
80 body of water
85 protrusion
90 receiver

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, an isometric view of the modular floating dock 10, according to the preferred embodiment of the present invention is disclosed. The modular floating dock 10 (herein also described as the "dock") 10, includes primarily of a box base 15 and a top walking surface 20 configured as a rectangular prism. The box base 15 is comprised of two (2) first sidewalls 25*a* and two (2) second sidewalls 25*b*, along with a mesh base 30. The first sidewalls 25*a* are designated as the short sides of the dock 10 and the second sidewalls 25*b* are designated as the long sides of the dock 10. It is envisioned that the box base 15 would be available in multiple sizes with the most common version being approximately three feet wide (3 ft.), ten feet (10 ft.) long and one foot (1 ft.) high. However, other sizes, both large and smaller could easily be constructed from the teachings of the present invention. As such, the exact dimensions of the present invention are not intended to be a limiting factor of the present invention.

The sidewalls 25*a*, 25*b* are envisioned to be constructed from dimensional wood lumber, however other materials such as plastic, recycled plastic, and the like, may also be utilized. The mesh base 30 provides openings 35 into the interior of the box base 15 to allow for water to freely move in and out of the box base 15. The mesh base 30 is envisioned to be made of an anti-corrosive metal such as aluminum or stainless steel to withstand exposure in a water-based environment. The mesh base 30 may be wrapped around the exterior of the box base 15 for fastening purposes as shown. The top walking surface 20 is envisioned to be constructed from dimensional wood lumber, however, other materials such as synthetic wood may also be utilized.

Figure 2:
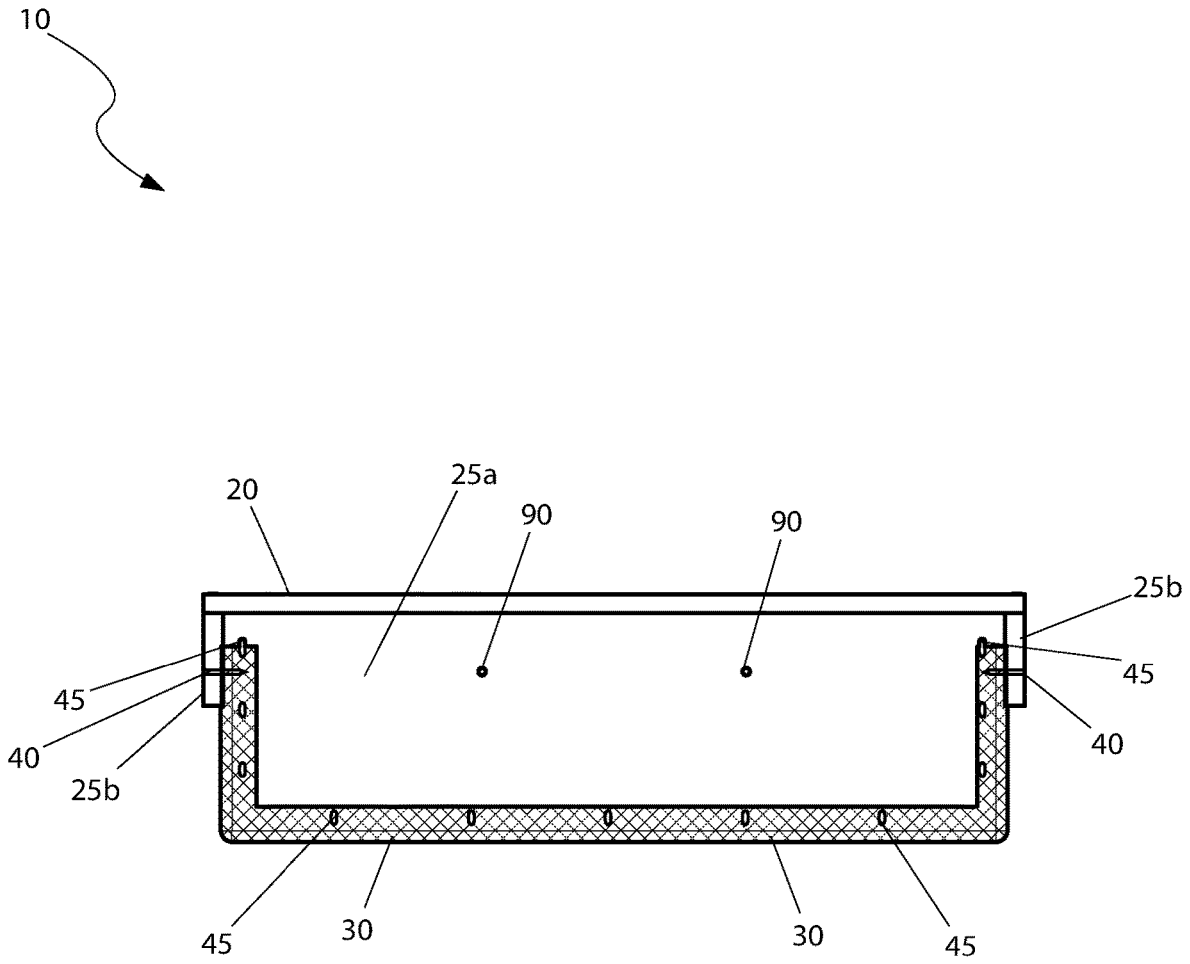
FIG. 2 is a side view of the modular floating dock 10, according to the preferred embodiment of the present invention.

Referring next to FIG. 2, a side view of the dock 10, according to the preferred embodiment of the present invention is depicted. First fasteners 40, such as nails or screws, are visible at distal ends where joining of adjacent sidewalls 25*a*, 25*b* take place at a ninety-degree (90°) angle. The mesh base 30 is shown wrapping around the perimeter of the portion of the first sidewalls 25*a* whereupon it is fastened with a series of second fasteners 45 such as staples. Both the first fasteners 40 and the second fasteners 45 are envisioned to be manufactured from an anti-corrosive material such as stainless steel to stand up to exposure in a water-based environment.

Figure 3:
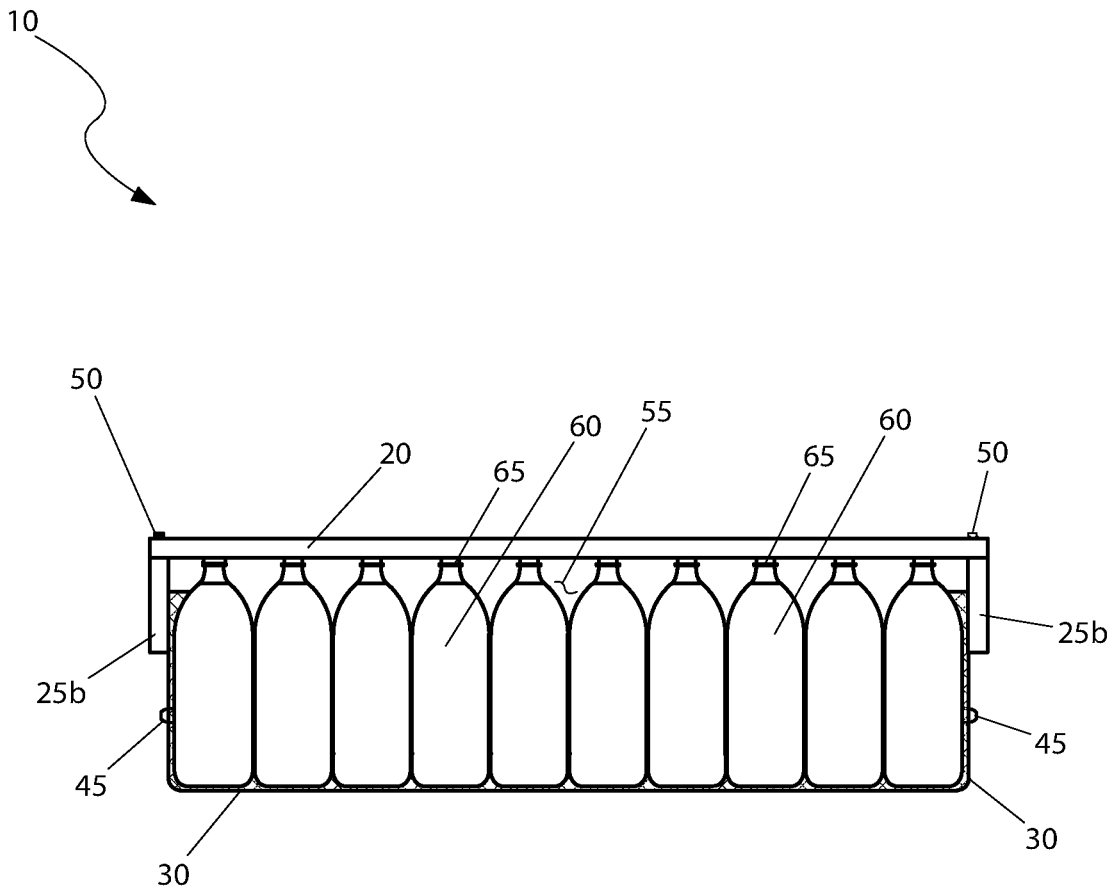
FIG. 3 is a sectional view of the modular floating dock 10, as seen along a line I-I, as shown in FIG. 2, according to the preferred embodiment of the present invention.

Referring now to FIG. 3, a sectional view of the dock 10, as seen along a line I-I, as shown in FIG. 2, according to the preferred embodiment of the present invention is shown. This sectional view is envisioned to disclose the smaller of the two (2) dimensions of the dock 10. The top walking surface 20 is attached to the tops of the second sidewalls 25*b* by use of multiple third fasteners 50, such as screws, to allow for easy removal should access to the box base interior 55 be needed at a future date for cleaning, maintenance, or repair. The mesh base 30 is depicted extending onto the exterior side of the first sidewalls 25*a* where the second fasteners 45 is visible penetrating the first sidewalls 25*a* to secure said mesh base 30 in place. Multiple containers 60 complete with caps 65 are provided in an array. The bottles 60 are envisioned to be used, but empty two (2) liter bottles, similar to those used for carbonated beverages, such as soda which are rinsed clean and tightly sealed via the caps 65. However, other sealed plastic containers 60, from both pre- and post-consumer usage, may also be used with equal effectiveness. As such, the use of any particular type of container 60 is not intended to be a limiting factor of the present invention. It is envisioned that the containers 60 will withstand long term exposure to almost any water environment 80 while also exhibiting resistance to contaminants such as spillage.

Figure 4:
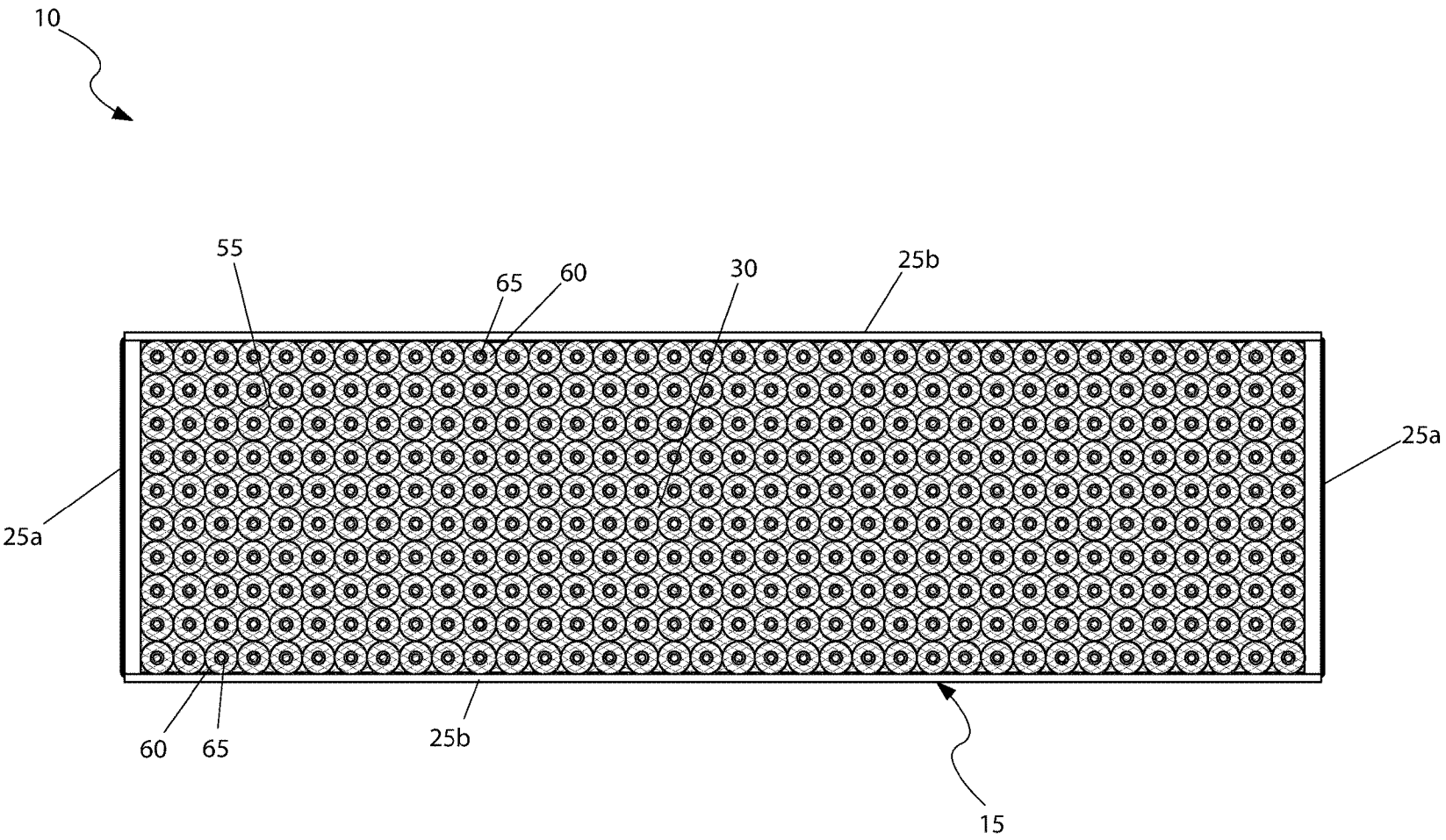
FIG. 4 is a sectional view of the modular floating dock 10, as seen along a line II-II, as shown in FIG. 2, according to the preferred embodiment of the present invention; and, FIG. 5 is a perspective view of multiple modular floating dock 10, shown in a utilized state, according to the preferred embodiment of the present invention.

Referring next to FIG. 4, a sectional view of the dock 10, as seen along a line II-II, as shown in FIG. 2, according to the preferred embodiment of the present invention is disclosed. The containers 60, complete with a sealed cap 65, are arranged in a rectangular array such that they fill the confines of the box base interior 55, as defined by the sidewalls 25*a*, 25*b*, while in an upright manner. While the exact quantity of the containers 60 utilized will vary per the chosen size of the box base 15, a common size of approximately three feet (3 ft.) wide and ten feet (10 ft.) long, would require approximately two-hundred-eighty (280) containers 60 arranged in a nine by thirty (9×30) grid as shown. The mesh base 30 is visible between the interstitial space of the containers 60.

Figure 5:
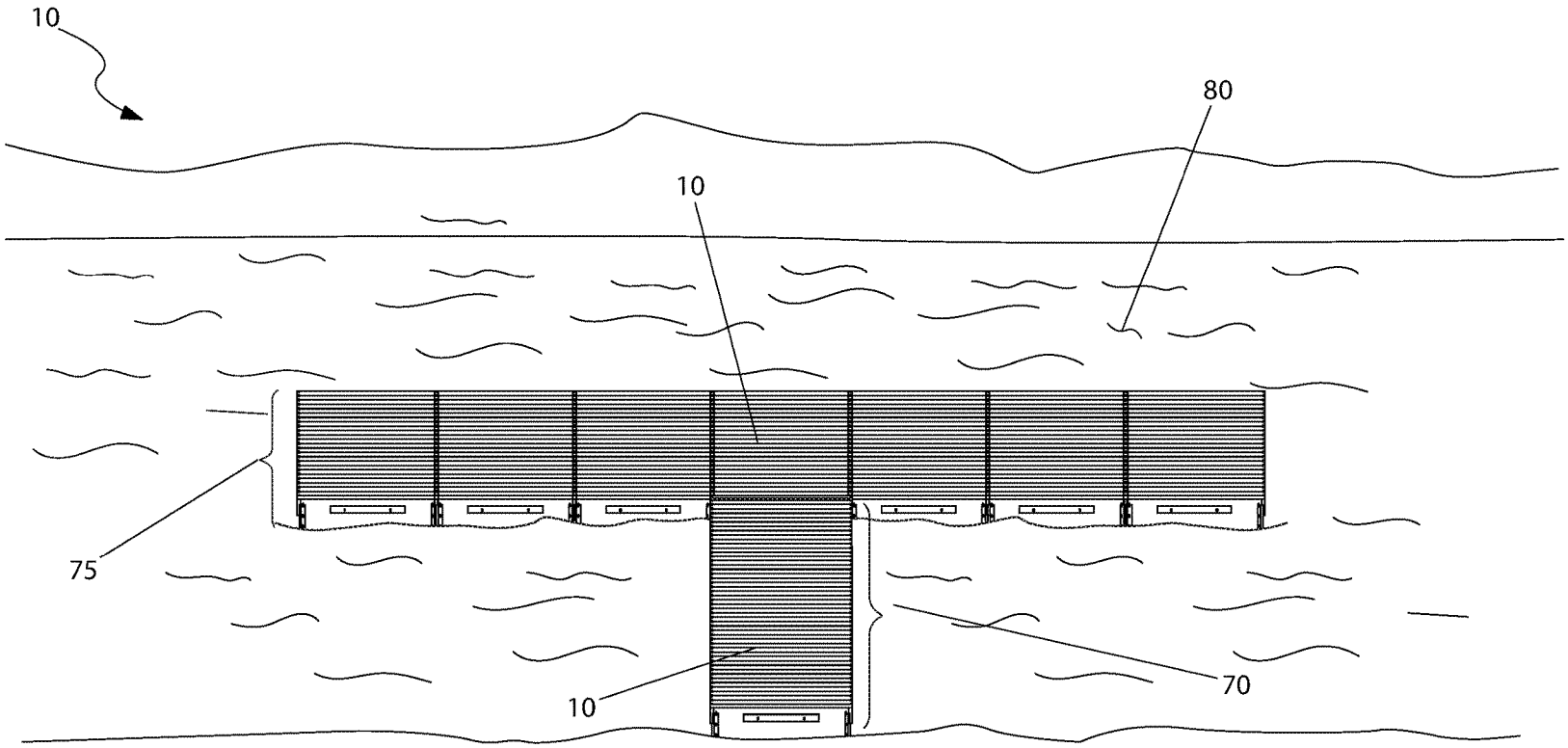

Referring to FIG. 5, a perspective view of multiple docks 10, shown in a utilized state, according to the preferred embodiment of the present invention is depicted. As the dock 10 is modular in design, it is envisioned that multiple docks 10 would be constructed and then transported to a point of use where they assembled into the final desired shape. FIG. 5 depicts a walkway 70 comprised of two (2) docks 10 and a dock area 75 comprised of seven (7) docks 10. The exact configuration is easily determined by the user as needed and may be changed or revised over time as well. This configuration may be made by bolting, strapping, eye bolt and hooks, or fastening method. The exact method of interconnection of the docks 10 is not limited by the present invention. In the exemplary embodiment, a bracket has at least one (1) protrusion 86 that extends away from both sides therefrom. Each protrusion 86 on a first side of the bracket 85 engages within a corresponding receiver 90 that is formed on any sidewall 25*a*, 25*b* of the dock 10. These protrusions 86 may be secured within the receivers 90. Each protrusion 86 on the second side of the bracket 85 is capable of engaging a receiver 90 formed on any sidewall 25*a*, 25*b* of an adjacent dock 10. These may be secured as well. Each dock 10 is envisioned to support up to one thousand two hundred pounds (1200 lbs.). Over the life of the dock 10, should any individual containers 60 become compromised (e.g., leaking), the remaining containers 60 will keep the dock 10 afloat until they can be replaced. It is envisioned that the dock 10 can be utilized on almost body of water 80, including but not limited to: ponds, lakes, rivers, streams, bays, or the like.

2. Operation of the Preferred Embodiment

The preferred embodiment of the present invention can be utilized by the common user in a simple and effortless manner with little or no training. It is envisioned that the dock 10 utilizing containers 60 would be constructed in general accordance with FIG. 1 through FIG. 5. The user would procure the dock 10 from conventional procurement channels such as marine supply houses, mail order or internet supply houses, or the like. Special attention would be paid to variables as aforementioned described, such as quantity of dock 10, material of construction, overall dimensions, and the like. It is envisioned that the dock 10 may be purchased with all containers 60 already installed or with the box base interior 55 in an empty state for filling with containers 60 by the final user.

After procurement and prior to utilization, the dock 10 would be prepared in the following manner: the dock 10, with containers 60 and sealed caps 65, is assembled into any configuration as desired; the dock 10 may be standalone, anchored to an adjacent shoreline, or anchored to the bottom of the body of water 80; adjacent docks 10 would be attached to each other using a method of the user's choosing.

During utilization of the dock 10, the following procedure would be initiated: user or users of the dock 10 may walk or sit upon the box base 15 of the dock 10 in a manner similar to that of any other floating dock.

It is noted that utilization of the dock 10 serves as an ecologically friendly way to reuse hundreds or thousands of containers 60 that would otherwise end up in landfills or recycling centers.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A modular floating dock, consisting of:

a box base having a pair of first sidewalls, a pair of second sidewalls, an interior, and a mesh base, the pair of first sidewalls are shorter than the pair of second sidewalls, the mesh base is wrapped around an exterior of the box base for fastening purposes, and the mesh base extends onto the exterior side of the first sidewalls to help secure said mesh base in place;

a top walking surface configured as a rectangular prism, the top walking surface is attached to the tops of the second pair of sidewalls;

a plurality of first fasteners joining the adjacent sidewalls at each of their distal ends;

a plurality of second fasteners fastening the mesh base around the perimeter of the pair of first sidewalls;

a plurality of third fasteners attaching the top walking surface to the tops of the second pair of sidewalls; and a bracket having at least one protrusion that extends away from both sides therefrom, each of the at least one protrusion on a first side of the bracket engages within a corresponding receiver that is formed on any sidewall of the modular floating dock;

wherein the mesh base provides a plurality of openings into the interior of the box base to allow for water to freely move in and out of the box base;

wherein the mesh base is made of material selected from the group consisting of anti-corrosive metal, aluminum, or stainless steel to withstand exposure in a water-based environment;

wherein the at least one protrusions are secured within the corresponding receivers;

wherein the modular floating dock supports up to one thousand two hundred pounds;

further comprising a plurality of containers each with corresponding caps are contained in an array within the modular floating dock;

wherein the containers are a plurality of empty two liter bottles which are rinsed clean and tightly sealed via the corresponding caps;

wherein the containers and sealed corresponding caps are arranged in a rectangular array such that they fill the box base interior while disposed in an upright manner; and further comprising a walkway having a pair of the modular floating docks and a dock area made of a plurality of additional modular floating docks.

2. The modular floating dock according to claim 1, wherein the sidewalls are made of material selected from the group consisting of dimensional wood lumber, plastic, or recycled plastic.

3. The modular floating dock according to claim 1, wherein the box base is three feet wide, ten feet long, and one foot high.

4. The modular floating dock according to claim 1, wherein the top walking surface is made of dimensional wood lumber.

5. The modular floating dock according to claim 1, wherein the top walking surface is made of synthetic wood.

6. The modular floating dock according to claim 1, wherein the first fasteners are a plurality of nails.

7. The modular floating dock according to claim 1, wherein the first fasteners are a plurality of nails screws.

8. The modular floating dock according to claim 1, wherein the first fasteners join the adjacent sidewalls at a ninety-degree angle.

9. The modular floating dock according to claim 1, wherein the second fasteners are a plurality of staples.

10. The modular floating dock according to claim 1, wherein the first fasteners and the second fasteners are made of an anti-corrosive material to stand up to exposure in a water-based environment.

11. The modular floating dock according to claim 10, wherein the first fasteners and the second fasteners are made of stainless steel to stand up to exposure in the water-based environment.

12. The modular floating dock according to claim 1, wherein the third fasteners are a plurality of screws, to allow for easy removal of the top walking surface to access to the box base interior for cleaning, maintenance, or repair.

13. The modular floating dock according to claim 1, wherein the walkway is made by fastening the modular floating docks together.

* * * * *